US006955135B1

(12) United States Patent
Wilkins

(10) Patent No.: US 6,955,135 B1
(45) Date of Patent: Oct. 18, 2005

(54) SELF-CONTAINED DRIVE-ON BOAT DOCKING APPARATUS, METHOD AND KIT FOR CREATING SUCH APPARATUS

(76) Inventor: James F. Wilkins, 860 Cedar Cove Rd., Henderson, NC (US) 27537

( * ) Notice: Subject to any disclaimer, the term of this patent is extended or adjusted under 35 U.S.C. 154(b) by 0 days.

(21) Appl. No.: 10/973,730

(22) Filed: Oct. 26, 2004

(51) Int. Cl.[7] ..... B63B 35/44
(52) U.S. Cl. ..... 114/263; 114/45; 405/3; 405/4
(58) Field of Search ..... 114/44, 45, 46, 114/263; 405/3, 4, 7; 414/467

(56) References Cited

U.S. PATENT DOCUMENTS

| | | | | |
|---|---|---|---|---|
| 3,951,087 A * | 4/1976 | Carson | 114/45 |
| 4,955,308 A * | 9/1990 | Craddock | 114/45 |
| 5,641,242 A * | 6/1997 | Riviere | 405/3 |
| 6,431,106 B1 | 8/2002 | Eva, III et al. | 114/263 |
| 6,477,968 B2 | 11/2002 | Powell | 114/46 |
| 6,520,728 B1 | 2/2003 | Schwitters | 414/467 |
| 6,547,485 B2 | 4/2003 | Elson | 405/3 |
| 6,602,022 B1 * | 8/2003 | Wilkins | 405/3 |
| 6,745,714 B1 | 6/2004 | Faber | 114/263 |
| 6,752,096 B2 | 6/2004 | Elson et al. | 114/45 |

* cited by examiner

*Primary Examiner*—Lars A. Olson
(74) *Attorney, Agent, or Firm*—B. B. Olive

(57) ABSTRACT

An apparatus for lifting and storing a boat above water and particularly for shallow water, is made up of a pair of laterally spaced floats fixedly secured to inner ends of a pair of beams whose outer ends are pivotally secured to a dock, a set of fixed posts, a bulkhead or other fixed structure. The floats and beams form a well having an entrance away from which is mounted a rear bar and further away from the rear bar and on the beams is mounted a front bar. A boat mounting frame onto which a boat can be driven under its own power is pivotally mounted on the rear bar such that after a boat is loaded on the boat mounting frame, the frame can be tilted such that its leading end engages the front bar and maintains the boat above the water in a position suited for storage. A method of forming the apparatus and a kit containing the apparatus is also disclosed.

19 Claims, 3 Drawing Sheets

FIG. 4
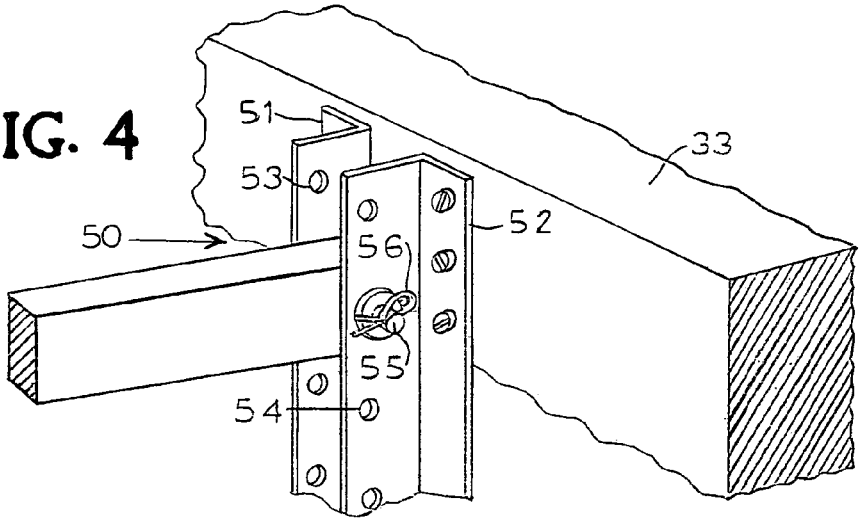
FIG. 5
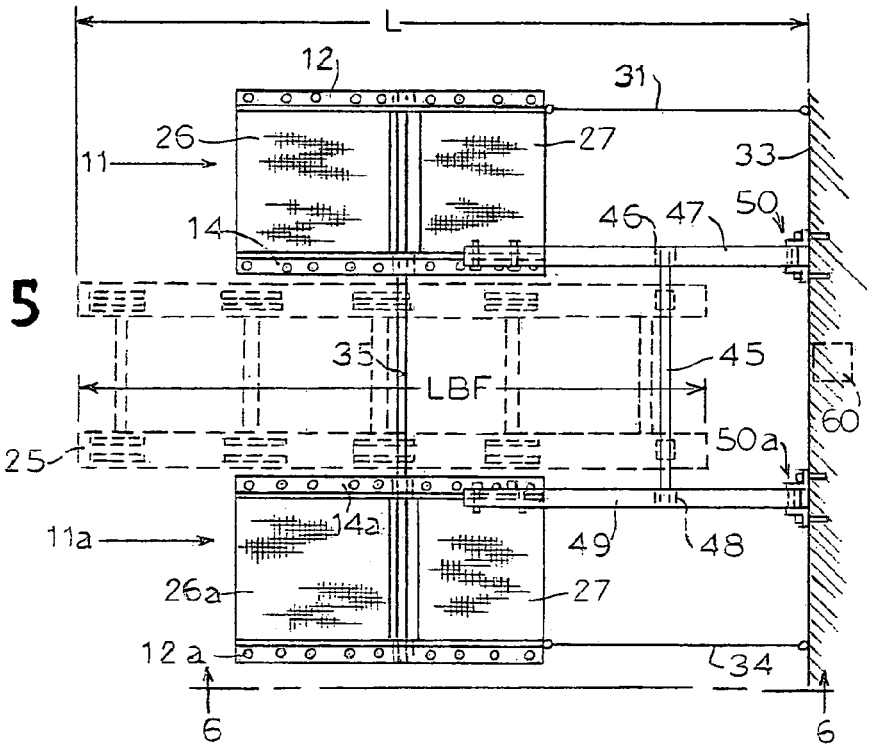
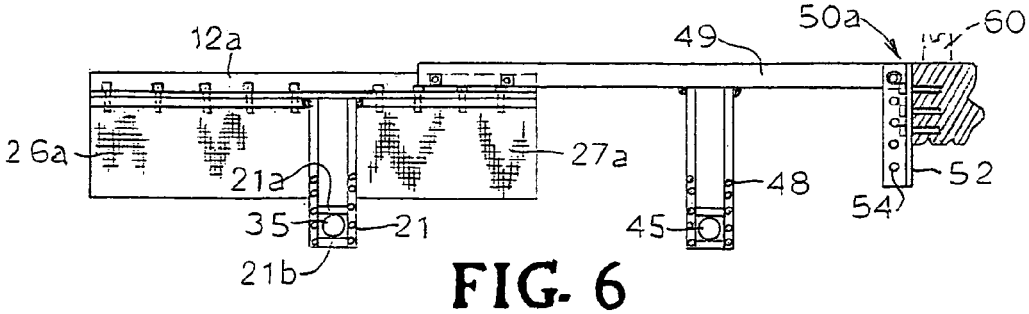
FIG. 6

SELF-CONTAINED DRIVE-ON BOAT DOCKING APPARATUS, METHOD AND KIT FOR CREATING SUCH APPARATUS

FIELD OF INVENTION

This invention relates to a self-contained boat docking apparatus suited to being detachably secured to a fixed dock, a set of fixed posts, a bulkhead or other such fixed structure. The invention apparatus is used for the purpose of docking, particularly in shallow water, and elevating a pleasure boat with its passengers. The invention further relates to a method and kit for creating such apparatus.

BACKGROUND OF INVENTION

The self-contained apparatus, method and kit of the present invention is based upon and represents an alternative and useful form of the apparatus, method and kit described in applicant's prior U.S. Pat. No. 6,602,022 issued Aug. 5, 2003. The contents of hereafter referred to '022 patent, are incorporated herein by reference.

As with the invention apparatus described in the '022 patent, the apparatus of the present invention is intended to facilitate removal of a pleasure boat from the water, elevating the boat, maintaining the boat in a stored position elevated above the water, and launching of the boat back into the water when desired. Pleasure boats of the kind to which the present invention is particularly adapted are, as with the invention of the '022 patent, thought of, for purpose of the present description, as being generally within the range of about fifteen to twenty-four feet in length and within the range of about 800 to 6,000 pounds in weight.

Further useful background information related to the present invention is to be found in the background information given in the '022 patent, and therefore will not be repeated here. What is to be recognized however is that the apparatus, method and kit of the '022 patent has brought about a significant improvement in the way pleasure boats are removed from the water, elevated, stored above and later returned to the water. Extensive use of the present invention docking apparatus incorporating the invention of the '022 patent is also to be recognized as having revealed a need for a self-contained docking structure exhibiting both the advantages of the docking structure of the '022 patent as well as the advantage of not being dependent for its construction and operation on any other docking structure. It further exhibits the advantage of being detachably and pivotally securable to a fixed dock, a fixed set of posts, a bulkhead and the like as a self contained operable apparatus.

With the foregoing in mind, the primary object of the present invention becomes that of providing a self contained pleasure boat docking apparatus which can operate without requiring other docking structure and in addition can be detachably and pivotally secured to an existing dock, a bulkhead, or other fixed objects such as a pair of posts adjacent a body of water. The apparatus of the present invention also has an object that of being uniquely adapted for use with a boat support frame, such as found in the '022 patent, onto which the boat can be driven, particularly in shallow water, loaded with passengers, and positioned ready for storage using only the motive power of the boat itself and which, after being positioned on the boat support frame, can with the boat support frame be pivoted so as to elevate the boat above the water for storage and later be pivoted in an opposite direction so as to be able to discharge the boat into the water for further use. The apparatus of the invention also has as an object that of being adapted to use a winching apparatus such as disclosed in the '022 patent.

A further object is that of providing an apparatus of the kind described which can be quickly assembled, quickly removed from the water and quickly disassembled.

Another object is that of providing a method and kit for creating the described apparatus. Other objects will become apparent through the detailed description to follow.

SUMMARY OF THE INVENTION

A self-contained apparatus is provided comprising and adapted for use with a rectangular boat support frame of a construction similar to that illustrated in the '022 patent, the boat support frame being adapted to receive a pleasure boat loaded with passengers and having adjustably supported laterally spaced support pads mounted on and running lengthwise of the boat support frame. A rear bar on which the boat support frame is pivotally mounted extends across and has its ends supported by buoyant float structures which effectively form and are located on opposite sides of a well. The support frame is mounted in a manner which permits load on the rear bar to be distributed onto the float structures. A pair of beams which further define and are located on opposite sides of the well are each adjustable lengthwise, are each secured at one end to one of the float structures and at an opposite end are each pivotally and vertically adjustably connected to a dock, post, bulkhead or other fixed surface. A front bar, located parallel to and forwardly of the rear bar is supported by and extends between and below the beams. The invention apparatus is particularly adapted for docking a pleasure boat in shallow water of three feet or even slightly less in depth. Within the scope of the invention there is also described the method of creating the described apparatus utilizing the mentioned boat support frame, beams, rear and front bars, and buoyant structures. There is also described as part of the invention a kit made up of such parts with instructions for assembling such parts.

BRIEF DESCRIPTION OF THE DRAWINGS

FIG. 4 is a perspective view of a vertically adjustable portion of the inner end of one of the beams and its pivotal and vertically adjustable metal fabricated bracket connection secured to a fixed surface.

FIG. 5 is a top plan view of the floating and pivotally supported dock portion of the invention apparatus adapted for and fitted with a boat support frame (shown in dashed lines), the front and rear bars of the invention and indicating the boat support frame pivotally mounted on the rear bar and resting on the front bar after being pivoted and winched into place.

FIG. 6 is a side elevation view taken in the direction of line 6—6 in FIG. 5 illustrating the form of the metal fabricated brackets on which the front and rear bars are mounted.

DETAILED DESCRIPTION OF PREFERRED EMBODIMENTS

The apparatus of the present invention is uniquely adapted to use of a boat support frame such as described in the '022 patent. Since the contents of the '022 patent are deemed to be incorporated herein by reference as previously stated, it is suggested that a reading and understanding of the '022 patent will be found helpful in understanding the present invention, as well as the differences between the present invention and that which is set forth in the '022 patent.

Figure 1:
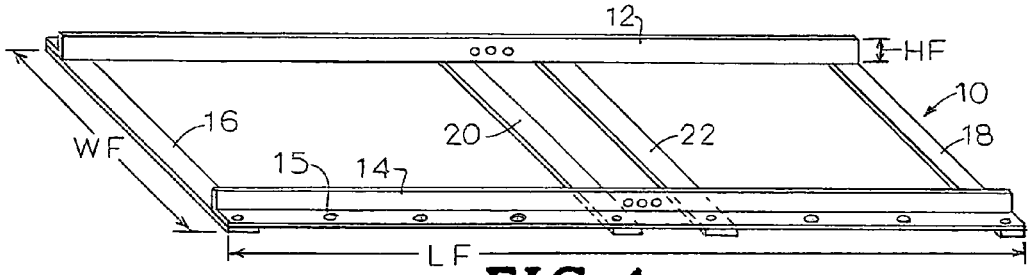
FIG. 1 is a top perspective view of one of a pair of float mounting frames used in the invention apparatus to each of which a pair of floats are attached.

Referring initially to FIG. 1 of the present invention, there is shown a substantially rectangular float mounting frame 10, made up in a welded galvanized steel construction of lengthwise extending right angle side rails 12, 14, crosswise extending outer flat rails 16, 18 and laterally spaced crosswise extending inner rails 20, 22. While not shown, bolts or other appropriate means may be used to reinforce or used instead of welding to secure the members of float mounting frame 10 together.

Figure 2:
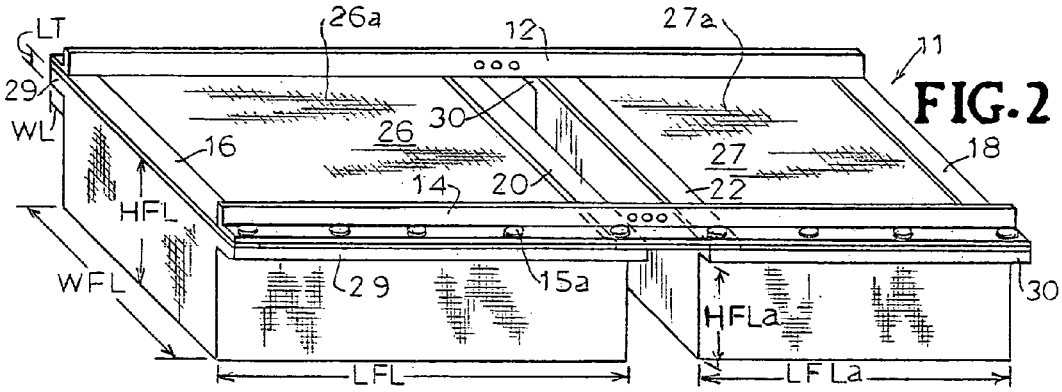
FIG. 2 is a top perspective view of the frame of FIG. 1 with a pair of floats attached so as to form one of a pair of float-frame assemblies used in the invention apparatus.
Figure 3:
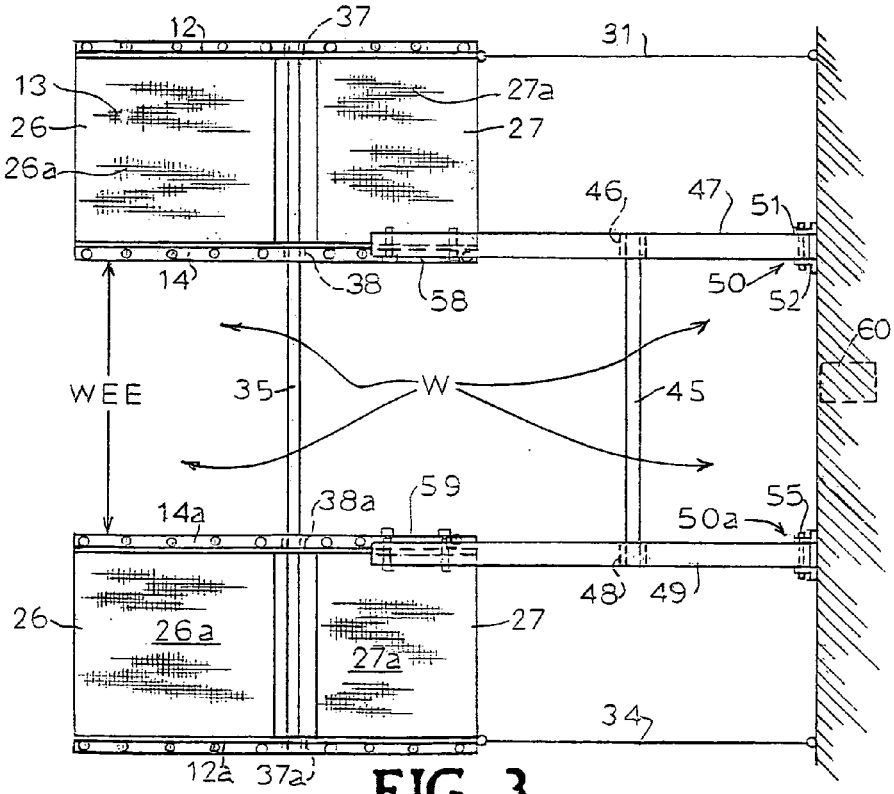
FIG. 3 is a top plan view of the floating and pivotally supported dock portion of the invention apparatus fitted with a pair of the laterally spaced float-frame assemblies of FIG. 2, the rear bar of the invention about which the boat support frame pivots and the front bar of the invention which supports the weight of the bow of the boat on the boat support frame after the boat has been pivoted and winched to its stored position by means of a winch indicated in dashed lines.

As best seen in FIG. 2, each float mounting frame 10 is used to mount a pair of buoyant floats which by way of example are illustrated as being a larger float 26 and smaller float 27. Floats 26, 27 are secured by means of bolts 15*a* (FIG. 2) placed in holes 15 (FIG. 1) or other means. Each float is preferably encased in a suitable coated fabric 26*a*, 27*a* respectively (FIGS. 2 and 3) and forms a component of a frame-float assembly 11. Dimensions of the components of the docking apparatus of the invention may vary according to the weight and size of the boats being docked, and thus floats 26, 27 may be of unequal size as illustrated by way of example in FIG. 2 or of equal size. In the embodiment being used as a reference for the present description based on a representative boat length of about 21 feet and representative weight of about 3200 pounds, the overall length L (FIG. 5) of the apparatus was 22 feet, the length LF of the float mounting and support frame 10 was 11 feet, the width WF was 4 feet and the height HF was 2½ inches. In the same embodiment, the width WFL of larger float 26 was 4 feet, its length LFL was 6 feet, and its height HFL was 18½ inches. The width WL of the lip 29 was 2½ inches and its thickness LT was 2½ inches. As seen in FIG. 2, the width WFLa (not shown) and the height HFLa (not shown) of smaller float 27 were the same as that of larger float 26. However, the length LFL(a) of smaller float 27 was 4 feet. Likewise, the lip 30 of smaller float 27 had the same width and thickness as did lip 29 of larger float 26. Both floats in the referenced embodiment were made of polyurethane material. In the embodiment being used for reference, the width WEE (FIG. 3) of the well W was 9 feet, and the length LBF (FIG. 5) of the boat mounting frame 25 was 16 feet. It was found through experiment that each block of foam of the size described with reference to the larger float 26 would support a weight in the water of 1828 pounds. As mentioned, float 26 is larger than float 27 and is designed such that when the boat 44 (FIG. 7) is being driven onto the boat mounting frame 25 (FIG. 7) a greater portion of the weight load is supported by float 26. During this procedure, it is also recognized that the occupant or occupants of the boat together with the weight of the boat motor will require greater buoyancy than will the unoccupied bow of the boat. As previously referred to and, as shown in FIG. 2, float frame 10 and floats 26, 27 make up a frame-float assembly 11. A pair of frame-float assemblies 11 and 11(*a*) of like construction are utilized in the present invention, as illustrated in FIG. 5.

While not shown in detail, it should also be understood that the boat mounting frame 25 is provided with laterally and longitudinally adjustable support means adapted to conform with the shape of the bottom surface of the boat as more fully explained in the '022 patent and for which the present invention is adapted.

Figure 7:
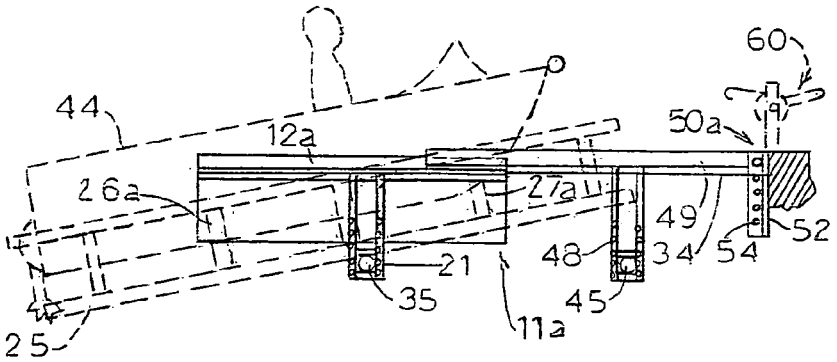
FIG. 7 is a side elevation view of the floating and pivotally supported dock portion of the invention apparatus fitted with the boat support frame and illustrating a pleasure boat resting on the boat support frame (both the boat support frame and boat are shown in dashed lines), which in turn is shown in FIG. 7 pivotally mounted and resting on the rear bar, but above the front bar and indicating the trailing end of the boat support frame pivoted downwardly in the position assumed by the boat support frame when ready to receive the boat.

A rear bar 35 connects frame-float assemblies 11, 11*a* and provides the support on which the boat mounting frame 25 (shown in dashed lines in FIG. 5) pivots. Each frame-float frame assembly 11, 11*a* supports rear bar 35 by a pair of bracket assemblies 37, 38 and 37*a*, 38*a* (FIG. 3) respectively made up in a welded galvanized steel construction in the form indicated in FIG. 6. Bracket assemblies 37, 38 are secured to and suspended from and below respective right angle side rails 12, 14 of float assembly 11. Bracket assemblies 37*a*, 38*a* are likewise secured to and suspended from and below respective right angle rails 12*a*, 14*a* of float assembly 11*a*. The height at which the rear bar 35 is supported is adjustable by means of the vertically adjustable crossbars 21*a*, 21*b* (FIG. 6) secured by respective bolts (not shown) in holes 21 (FIG. 7 and FIG. 8).

A pair of metal fabricated beams 47, 49 are each secured by appropriate lengthwise adjustable securing means 58, 59 at a respective inner end to and extend from a corner of one of frame-float assemblies 11, 11*a*. The outer ends of beams 47, 49 are each pivotally and vertically adjustably mounted on a dock, a post, a bulkhead, or other fixed surface by pivotal and vertically adjustable mounting arrangements 50, 50*a* respectively as seen in FIG. 4. Such arrangements comprise vertical right angle supports 51, 52 (FIG. 4) formed with vertical spaced holes 53, 54 respectively adapted to receive pin 55 secured by cotter pin fastener 56 as best seen in FIG. 4. In an alternative arrangement, not shown, the outer ends of beams 47, 49 are joined and connected to a dock, a bulkhead or other fixed surface through a single rather than a pair of pivotal connections. A winch apparatus 60 is fixedly mounted on dock 33 and is used to draw the boat 44 into place on the boat mounting frame 25 as shown in FIGS. 7 and 8. Lengthwise adjustment of beams 47, 49 enables the docking apparatus to be adjusted for the length of the boat. Suitable secured stabilizing cables 31, 34 extend from a respective opposite corner of a respective float assembly 11, 11*a*. The outer ends of beams 47, 49 are each pivotally and vertically adjustably mounted on a dock, a post, a bulkhead, or other fixed surface by pivotal and vertically adjustable mounting arrangements 50, 50*a* respectively as seen in FIG. 5. Such arrangements comprise vertical right angle supports 51, 52 formed with vertical spaced holes 53, 54 adapted to receive pin 55 secured by cotter pin fastener 56 as best seen in FIG. 4. In an alternative arrangement, not shown, the outer ends of beams 47, 49 are joined and connected to a dock, a bulkhead or other fixed surface through a single rather than a pair of pivotal connections. A winch apparatus 60 is fixedly mounted on the dock 33 and is used to draw the boat 44 into place on the boat mounting frame 25 as shown in FIGS. 7 and 8.

Figure 8:
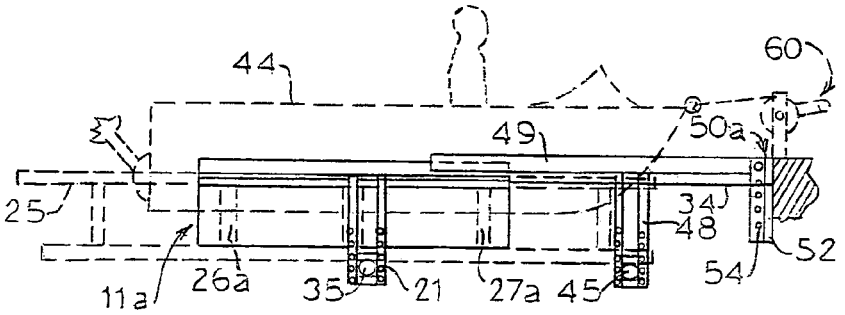
FIG. 8 is an elevation view of the floating and pivotally supported dock portion of the invention apparatus as shown in FIG. 7 but with the leading end of the boat support frame on which the boat rests (both the boat support frame and boat are shown in dashed lines) shown resting on the front bar and with the boat in an elevated position above the water suitable for storage.
Figure 10:
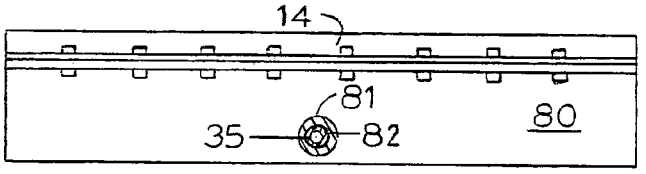
FIG. 10 is a side elevation view of a floatation structure made as a single, integral structure.

The front bar 45 on which the leading end of the boat mounting frame 25 rests when the boat 44 is in its elevated position (as shown in FIG. 8) is supported by a separate set of bracket assemblies 46, 48 secured to and supported from and below respective ones of the beams 47, 49. Bracket assemblies 46, 48 which support front bar 45 are similar in construction to the previously described vertically adjustable bracket assemblies 37, 38 which support rear bar 35. Thus, both rear bar 35 as well as front bar 45 can be adjusted to the preferred height according to the weight of the boat. Here it should be understood that the pair of floats 26, 27 could be formed as a single integral float 80 (FIG. 10) with a formed hole 81, a metal or plastic tube 82 inserted in hole 81 and mounting rear bar 35, with the outer ends of bar 35 being supported by the previously referred to brackets 37, 38, 37*a*, 38*a* shown in FIG. 3 but not in FIG. 10. FIG. 10 also illustrates integral float 80 secured to side rail 14. Also to be understood is that each such single, integral float 80, as illustrated in FIG. 10, could instead of being formed of polyurethane be formed as an inflated or airtight flexible or rigid container or as a pair or more of such containers. Thus, the apparatus of the invention adapts itself to a variety of forms of buoyant structures.

Figure 9:
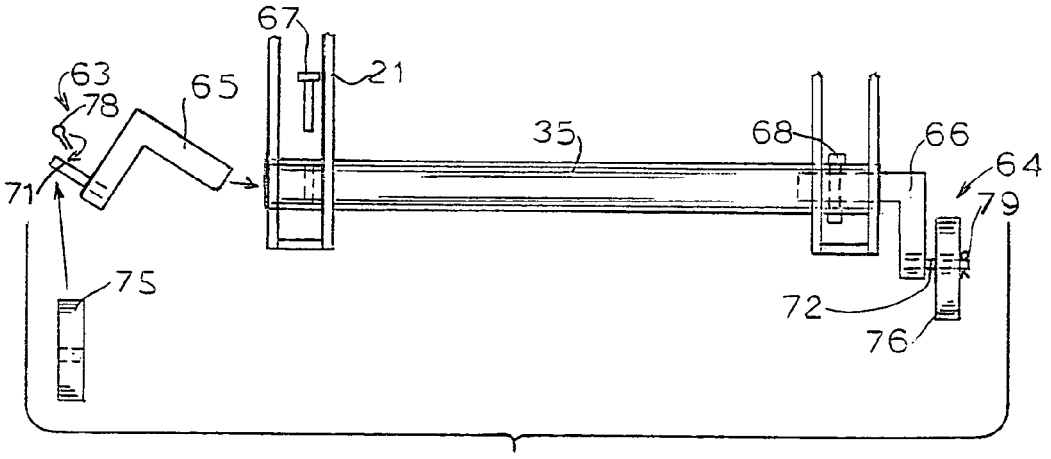
FIG. 9 is a side view illustrating a dual wheel structure adapted for being inserted into the rear bar on which the boat frame pivots when it is desired to transport the invention apparatus over land; one wheel structure being shown in place with the other wheel structure being shown in an exploded view.

Attention is next directed to FIG. 9 which illustrates a pair of roller assemblies 63, 64 which are adapted to fit into the outermost ends of rear bar 35, which for this purpose is formed as a hollow cylinder. Roller assemblies 63, 64 are made up of a pair of right angle tubular members 65, 66 one end of which is slid into a respective outer end of rear bar 35 and secured in place by a respective pin 67 or 68. Axles 71, 72 are secured in respective ends of tubular members 65, 66 by suitable means. A pair of wheels 75, 76 mount on respective free ends of axles 71, 72 and are held in place by respective cotter pins 78, 79. Once roller assemblies 63, 64 are placed on rear bar 35, the entire invention apparatus can be rolled from the water and stored. In order to do this, the beam mounting arrangements 50, 50*a* are disconnected by removing cotter pin fasteners 56, 56*a* (not shown) and pins 55, 55*a* (not shown) which allows the entire invention apparatus to be pulled to dry land when wheels 75, 76 reach the point that they touch the bottom of the lake or other body of water where the apparatus of the invention is being used.

While not shown, it should be further understood that the boat mounting frame 25, illustrated in FIGS. 5, 7 and 8 can be constructed for receiving a pontoon type boat as illustrated in the '022 patent and for which the apparatus of the present invention is readily adapted. It will also be appreciated that the boat mounting frame 25 could be constructed for or specifically used for docking a jet-ski type boat.

In summary and to conclude the description, it can be seen that the apparatus of the invention does achieve the objects previously set forth and in particular provides an apparatus which:

(1) is self-contained, operates without requiring other docking structures, and provides an apparatus capable of receiving and thereafter elevating and storing the pleasure boat;

(2) is adapted to be used in relatively shallow water of three feet or even somewhat less in depth;

(3) is adapted for being pivotally connected to one or more fixed surfaces on a dock, a pair of fixed posts, a bulkhesd, or the like;

(4) is adapted to be quickly assembled, quickly placed in the water, quickly removed from the water, and then quickly disassembled;

(5) is adapted when in use with the boat empty of passengers and while being tilted towards the front bar to place all of the weight of the boat on the single rear bar;

(6) is adapted such that a boat can be driven onto the docking apparatus of the invention with its passengers on board;

(7) is adapted to operate without requiring any floatation other than that provided by the apparatus itself;

(8) is adapted by reason of the rear and front bars being mounted in a manner which enables their depth to be adjusted to accommodate to a range of relatively shallow water depths;

(9) is adapted to use a wide range of types of floatation structures for each side of the apparatus, including those formed as pivotal structures, single integral structures, foamed molded structures, air tight and inflated structures;

(10) is adapted to be used with any of a wide variety of floatation structures including those formed as plural or single structures and made of solid foam or an inflated or air-tight container; and

(11) is adapted by reason of the outer ends of its beams being pivotally connected to a fixed surface to readily accommodate to tides and levels of water which change after a boat has been loaded on the invention apparatus.

What is claimed is:

1. An apparatus adapted for being installed in a body of water and secured where installed to one or more accessible fixed surfaces for the purpose of receiving, supporting and elevating a boat of the type having normally submerged propulsion means mounted proximate the stern of the boat, comprising:

(a) a pair of laterally spaced buoyant structures adapted when installed in said body of water to establish a well therebetween;

(b) a pair of laterally spaced parallel beams each being secured at an outer end to a fixed surface and at an opposite inner end being secured to a selected one of said buoyant structures, said beams defining a continuation of the boundaries of said well;

(c) a rear bar member located forward of an entrance to said well and extending across and terminating at each of outer ends outwardly of opposite sides of said well, said rear bar outer ends being secured to said buoyant structures and being operative by reason of such securement to distribute a load placed thereon across said buoyant structures;

(d) a boat support frame having a forward end, an opposing rear end, side members joined together and extending between said forward and rear ends, said side members including means adapted for contacting and supporting the bottom surface of said boat in conformance with its shape and said rear end of said frame being formed so as to permit forward passage of said propulsion means between said side members during positioning of said boat on said frame by use of said propulsion means, said frame being pivotally mounted on said rear bar member such that a selected portion of the length of said frame is disposed rearwardly of said rear bar member and the weight of said frame is distributed on said rear bar member in a manner which tends to cause the trailing said rear end of said frame when not having a boat mounted thereon to pivot downwardly into water confined proximate the entrance to said well, and the said forward end to pivot upwardly;

(e) a front bar member extending across said well and positioned parallel to and forward of said rear bar member and having outer ends supported by said beams; and (f) said boat support frame, beams, rear bar member, front bar member and buoyant structures being arranged and constructed such that said boat may be driven onto said boat support frame by use of its own said propulsion means, lifted by said buoyant structures and positioned for storage and then drawn down by pivoting said frame on said rear bar member to bring said forward end of said frame down to rest on said front bar member.

2. An apparatus as claimed in claim 1 wherein the securement of said outer end of said beam is by means of a pivotal connection.

3. An apparatus as claimed in claim 1 wherein said outer ends of said front bar member are supported both by and below said beams.

4. An apparatus as claimed in claim 1 wherein said boat support frame, beams, rear bar member, front bar member and buoyant structures are arranged and constructed such that said boat can be driven onto said frame in shallow water of a depth of about three feet.

5. An apparatus as claimed in claim 1 wherein each of said buoyant structures comprise a pair of buoyant structures between which said rear bar member is supported.

6. An apparatus as claimed in claim 1 wherein each of said buoyant structures comprises a single integral buoyant structure.

7. An apparatus as claimed in claim 1 wherein said bars are supported in a manner which enables the depth at which said rear bar and front bar are supported to be adjustable.

8. An apparatus as claimed in claim 5 wherein each of said buoyant structures are formed of a buoyant plastic foam material.

9. An apparatus as claimed in claim 5 wherein each of the buoyant structures of said pair exhibit a different buoyant force when afloat.

10. An apparatus as claimed in claim 1, including means enabling the length of each of said beams to be adjusted.

11. An apparatus as claimed in claim 1 wherein said rear bar member is formed as a rigid hollow tube including a pair of wheels and means for mounting and positioning said wheels at opposite ends of said rear bar member in a manner which permits said apparatus to be moved while supported by said wheels.

12. An apparatus as claimed in claim 1 wherein said buoyant structures each comprise a single integral buoyant structure.

13. A kit of components suited to forming an apparatus adapted for being installed in a body of water and secured where installed to one or more accessible fixed surfaces for the purpose of receiving, supporting and elevating a boat of the type having normally submerged propulsion means mounted proximate the stern of the boat, comprising:

(a) a pair of laterally spaced buoyant structures adapted when installed in said body of water to establish a well therebetween;

(b) a pair of laterally spaced parallel beams each being adapted for being pivotally secured at one outer end to a fixed surface and at an opposite inner end to a selected one of said buoyant structures and in a manner defining a continuation of the boundaries of said well;

(c) a rear bar member adapted for being located forward of an entrance to said well so as to extend across and terminate at each of opposite ends outwardly of opposite sides of said well, said rear bar member outer ends being further adapted for being secured to said buoyant structures and operative by reason of such securement to distribute a load placed thereon across said buoyant structures;

(d) a boat support frame having a forward end, an opposing rear end, side members joined together and extending between said forward and rear ends, said side members being adapted for mounting support means extending longitudinally and outwardly of said frame for contacting and supporting the bottom surface of said boat in conformance with its shape and said rear end of said frame being formed so as to permit forward passage of said propulsion means between said side members during positioning of said boat on said frame by use of said propulsion means, said frame being adapted for being pivotally mounted on said rear bar member such that a selected portion of the length of said frame can be disposed rearwardly of said bar member in a manner which tends to cause the trailing said rear end of said frame when not having a boat mounted thereon to pivot downwardly into water confined proximate the entrance to said well, and the said forward end to pivot upwardly;

(e) a front bar member adapted to extend across said well and to be positioned parallel to and forward of said rear bar member and having outer ends adapted for being supported by said beams; and (f) said boat support frame, beams, rear bar member, front bar member and buoyant structures being constructed and adapted for being arranged such that said boat may be driven onto said boat support frame by use of its own said propulsion means, lifted by said buoyant structures and positioned for storage and then drawn down by pivoting said frame on said rear bar member to bring said forward end of said frame down to rest on said front bar member.

14. A kit of components as claimed in claim 13 wherein said buoyant structures each comprise a pair of buoyant structures.

15. A kit of components as claimed in claim 13 including a pair of wheels and means for mounting said wheels at opposite ends of said rear bar member in a manner which permits said apparatus to be moved while supported by said wheels.

16. A method for forming an apparatus suited for being installed in a body of water and secured where installed to one or more accessible fixed surfaces for the purpose of receiving, supporting and elevating a boat of the type having normally submerged propulsion means mounted proximate the stern of the boat, comprising:

(a) forming a pair of buoyant structures adapted when installed in a laterally spaced relation in said body of water to establish a well therebetween;

(b) forming a pair of laterally spaced parallel beams each being adapted for being pivotally secured at one outer end to a fixed surface and adapted at an opposite inner end for being secured to a selected one of said buoyant structures, said beams being further adapted for defining a continuation of the boundaries of said well;

(c) forming a rear bar member adapted for being located forward of an entrance to said well and extending across and terminating at each of opposite ends outwardly of opposite sides of said well, said opposite ends being further adapted for being secured to said buoyant structures and adapted by being operative by reason of such securement to distribute a load placed thereon across said buoyant structures;

(d) forming a boat support frame having a forward end, an opposing rear end, side members joined together and extending between said forward and rear ends, and being adapted for contacting and supporting the bottom surface of a boat in conformance with its shape and said rear end of said frame being formed so as to permit forward passage of said propulsion means between said side members during positioning of said boat on said frame by use of said propulsion means, said frame being further adapted for being pivotally mounted on said rear bar member such that a selected portion of the length of said frame is disposed rearwardly of said bar member and the weight of said frame is distributed on said rear bar member in a manner which tends to cause the trailing said rear end of said frame when not having a boat mounted thereon to pivot downwardly into water confined proximate the entrance to said well, and the said forward end to pivot upwardly;

(e) forming a front bar member adapted to extend across said well and to be positioned parallel to and forward of said rear bar member and for having its outer ends supported by said beams; and (f) assembling said boat support frame, beams, rear bar member, front bar member and buoyant structures such that said boat may be driven onto said boat support frame by use of its own said propulsion means, lifted by said buoyant structures and positioned for storage and then drawn down by pivoting said frame on said rear bar member to bring said forward end of said frame down to rest on said front bar member.

17. A method as claimed in claim 16 wherein each said buoyant structure is formed as one of a pair of buoyant structures.

18. A method as claimed in claim 16 wherein each said buoyant structure is formed as a single integral buoyant structure.

19. A method as claimed in claim 16 including the step of mounting and positioning a pair of wheels at opposite ends of said rear bar member in a manner which permits said apparatus to be moved while supported by said wheels.

* * * * *